United States Patent [19]

Ando

[11] Patent Number: 4,754,849

[45] Date of Patent: Jul. 5, 1988

[54] CONTROL SYSTEM FOR ELEVATOR CAGE GUIDE MAGNETS

[75] Inventor: Hiroshi Ando, Inazawa, Japan

[73] Assignee: Mitsubishi Denki Kabushiki Kaisha, Tokyo, Japan

[21] Appl. No.: 60,892

[22] Filed: Jun. 12, 1987

[30] Foreign Application Priority Data

Sep. 29, 1986 [JP] Japan ..... 61-230883

[51] Int. Cl.[4] ..... B66B 7/04

[52] U.S. Cl. ..... 187/95; 104/293

[58] Field of Search ..... 187/95; 384/33; 104/293; 310/90

[56] References Cited

FOREIGN PATENT DOCUMENTS

| | | |
|---|---|---|
| 47-5177 | 3/1972 | Japan . |
| 51-116548 | 10/1976 | Japan . |
| 60-36279 | 2/1985 | Japan . |
| 60-52070 | 11/1985 | Japan . |

*Primary Examiner*—F. J. Bartuska
*Assistant Examiner*—Stephen Parker
*Attorney, Agent, or Firm*—Sughrue, Mion, Zinn, Macpeak and Seas

[57] ABSTRACT

Continuous, vertically tensioned steel cables 31, 32 or straps 39, 40, 41 mounted in an elevator shaft 2 serve as tracking standards for air gap detectors 33, 34, 35 mounted to a passanger cage 5. The detector outputs differentially control electromagnet pairs 6, 7, 8 mounted on the cage and cooperable with vertical guide rails 1 to maintain the sensed air gaps at a constant, predetermined value.

3 Claims, 2 Drawing Sheets

CONTROL SYSTEM FOR ELEVATOR CAGE GUIDE MAGNETS

BACKGROUND OF THE INVENTION

This invention relates to a system for controlling the energization of electromagnets disposed adjacent vertical guide rails in an elevator installation.

In older elevator systems the cage is typically guided during its upward and downward travel by shoes or rollers mounted to the cage and engaging vertical rails fixed to the walls of the elevator shaft or hoistway. If the joints between any two successive rail elements are misaligned or migrate out of alignment with use, however, the cage is subject to shaking and vibration as the shoes or rollers traverse the joints. Such jostling obviously leads to fear and apprehension in the passengers.

To overcome this problem a contactless guide system has been developed as disclosed in Japanese Kokai No. 51-116548 and as illustrated in FIGS. 1 through 4, wherein T-shaped iron guide rails 1 are mounted to the opposite walls of an elevator shaft 2 housing a passenger cage 5 having a frame 3 suspended by ropes or cables 4. Three electromagnets 6, 7 and 8 are secured to the top and bottom of the frame on opposite sides of the cage, and surround the guide rails 1 as best seen in FIG. 2. The magnets have C-shaped iron cores 9, 10, 11 respectively wound by coils 12, 13, 14, and their end faces are spaced or gapped from the adjacent surfaces of the guide rails. Although not fully illustrated, there are four groups of three magnets each as will be readily understood. A detector 15 is mounted next to the core 10 for sensing the gap between the end faces of the core and the side of the rail 1. A detector 16 mounted next to core 11 similarly senses the gap at the innermost portion of the rail, and a further gap detector 17 is associated with magnet 7A on the opposite side of the cage frame.

The control circuit for coils 12 and 13 is shown in FIG. 4, wherein differential firing circuits 21, 22 control the firing angles of thyristors 19, 20 coupled between the respective coils and AC power source 18 in response to the output of gap detector 15. Similar control circuitry would be provided for magnets 6A, 7A associated with detector 17, magnets 8, 8A associated with detector 16, as well as the three magnet pairs and associated gap detectors mounted to the bottom or underside of the cage frame.

In operation, and referring first to opposing magnets 6 and 7, when the gap sensed by detector 15 is equal to a predetermined value thyristors 19 and 20 are fired at the same angle and thus apply equal energization to the coils 12, 13 whereby the magnets 6, 7 equally attract (or repel) the centered guide rail 1. If the gap between core 10 and the side of the rail decreases, however, the increased output of detector 15 differentially controls the firing circuits 21, 22 such that the energization of coil 12 is increased while that of coil 13 is decreased. The resulting differential or unequal forces generated by the opposing pair of magnets 6, 7 thus acts to re-center the guide rail between them, as may be easily understood. The other five pairs of cooperating or associated electromagnets are differentially controlled in a similar manner in response to the outputs of their respective gap detectors such that the guide rails are maintained centered as shown in FIG. 2 to define equal opposing air gaps and smoothly guide the cage during its travel without any disruptive physical contact with the rails.

The performance of such a conventional contactless guide system is still fully dependent on the precise axial alignment of the successive vertical guide rails, however, which as a practical matter is almost impossible to accurately establish and maintain. Thus, if a joint between two successive rails migrates laterally due to settling, thermal expansion or the like as exaggeratedly shown in FIG. 3, the cage is subjected to shaking and vibration as the centering magnets strive to follow the misaligned joint. The problem can be corrected by realigning the guide rails, but this is obviously very labor intensive, disruptive and costly.

SUMMARY OF THE INVENTION

These drawbacks and disadvantages of the prior art are effectively overcome by the present invention, in accordance with which continuous vertical tracking standards are installed in the elevator shaft in parallel with the guide rails, in the form of tensioned steel cables or straps. The gap detectors for each pair of magnets are then mounted to the cage frame adjacent the tracking standards, and their outputs control the energization of the magnets just as before. In other words, the magnet pairs still cooperate with the guide rails to control the side to side and fore and aft positioning of the elevator cage during its travel, but the discontinuous and sometimes misaligned guide rails no longer cooperate with the detectors to define the air gaps being sensed and maintained. This function is instead served by the vertically tensioned tracking standards, which are easily installed in the hoistway and, being continuous, do not suffer from any of the joint misalignment or migration problems associated with the prior art.

DETAILED DESCRIPTION OF THE PREFERRED EMBODIMENTS

Figure 1:
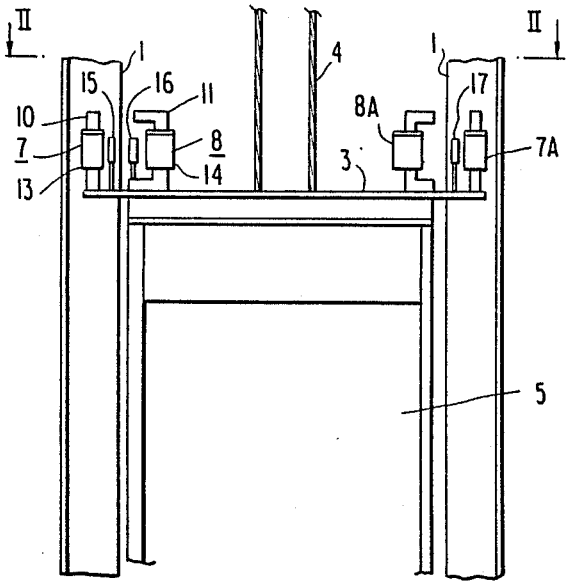
FIG. 1 PRIOR ART
FIG. 1 is a schematic elevation of a conventional contactless guide system for an elevator cage.
Figure 3:
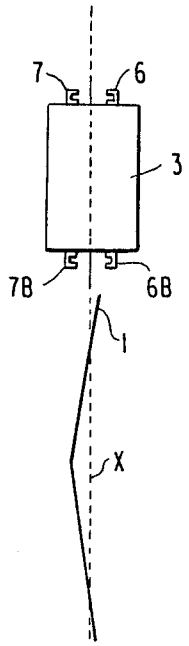
FIG. 3 PRIOR ART
FIG. 3 is a simplified elevation taken on line III—III in FIG. 2.
Figure 2:
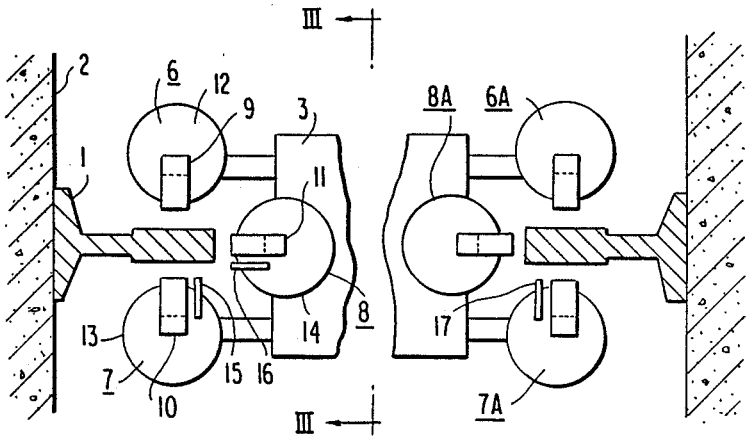
FIG. 2 PRIOR ART
FIG. 2 is a partial, enlarged sectional view taken on line II—II in FIG. 1.
Figure 4:
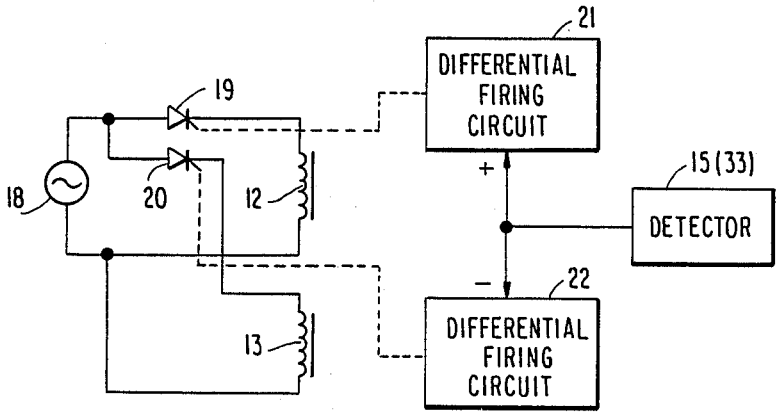
FIG. 4 PRIOR ART
FIG. 4 is a schematic diagram of a conventional electromagnet control system for the apparatus of FIG. 1.
Figure 5:
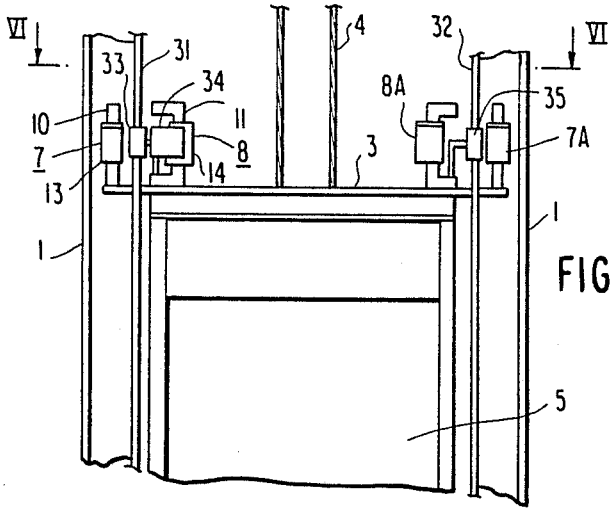
FIG. 5 is a schematic elevation of a contactless guide system for an elevator cage in accordance with the invention.
Figure 7:
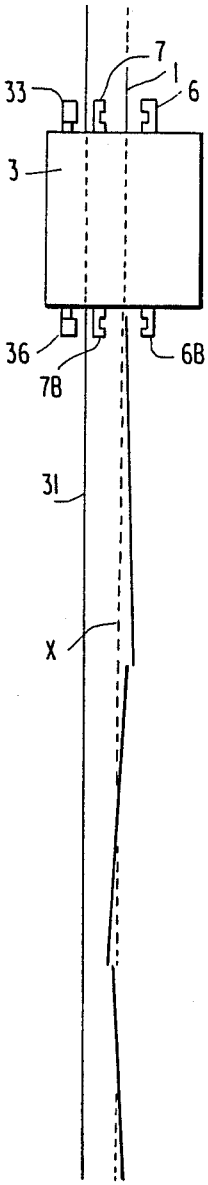
FIG. 7 is a simplified elevation taken on line VII—VII in FIG. 6.
Figure 6:
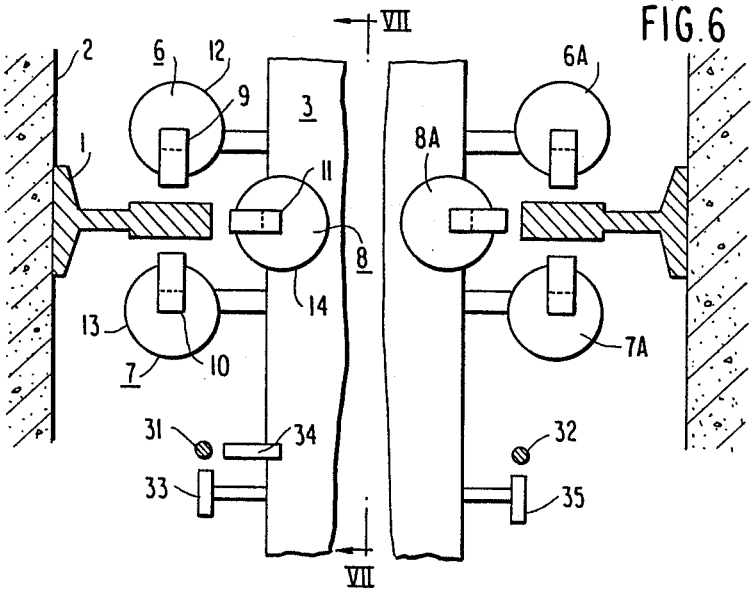
FIG. 6 is a partial, enlarged sectional view taken on line VI—VI in FIG. 5.

Referring to FIGS. 5 through 7, wherein like reference numerals identify the same elements described above in connection with FIGS. 1–4, a pair of vertical tracking standards 31, 32 in the form of tensioned steel wires, cables or the like are installed in the elevator shaft 2 on opposite sides of the cage 5 and parallel to each other and to the guide rails 1. The tracking standards 31, 32 are continuous, and their opposite ends are rigidly secured to upper and lower termini of the shaft in any suitable manner. A gap detector 33 associated with magnets 6, 7 is mounted to the cage frame 3 proximate standard 31, and its output is applied to the control circuit of FIG. 4 as indicated in parenthesis to appropriately control the energization of the magnet coils 12, 13. In a similar manner, a gap detector 34 associated with magnets 8, 8A is provided on the cage frame proximate standard 31, and a gap detector 35 associated with magnets 6A, 7A is mounted on the opposite side of the frame proximate standard 32. The detectors 33, 34, 35 are functionally equivalent to and operate in substantially the same manner as previously described gap detectors 15, 16, 17, respectively. As will be readily understood, three additional gap detectors (not shown) are mounted in a similar manner on the underside of the cage frame for appropriately controlling the three additional magnet pairs fixed to the bottom of the frame. One of the lower detectors 36 is visible in FIG. 7. All of the detector outputs are applied to thyristor firing angle/magnet coil energization control circuits identical to that shown in FIG. 4. The gap detectors may be of the electrostatic-capacity type, electromagnetic type, Hall element detectors, optical gap detectors, etc. all well known in the art and forming no part of the invention per se.

In operation, the outputs of the gap detectors 33, 34, 35 control the energization of their associated pairs of opposing magnet coils just as described above, although the magnets are no longer controlled to maintain the guide rails centered between the opposing magnet cores. Instead, the energization of the magnets now serves to maintain the air gaps shown in FIG. 6 between the tracking standards 31, 32 and their associated detectors 33, 34 and 35 at a constant value, irrespective of any axial misalignments between the successive guide rail elements or lateral migrations of their joints. In accordance with the invention, the guide rails 1 thus primarily serve as ferrous bulk members to complete the flux paths of the electromagnet cores and to establish fixed masses against which the attractive forces generated by the magnets may be applied to appropriately control the contactless guiding of the elevator cage. As will be readily understood the forces generated by the various magnet pairs could be repulsive instead of attractive with the same effect.

The circuit components 21, 22 shown in FIG. 4 for controlling the thyristor firing angles may be of the type disclosed in Japanese Kokai No. 47-5177.

Figure 8:
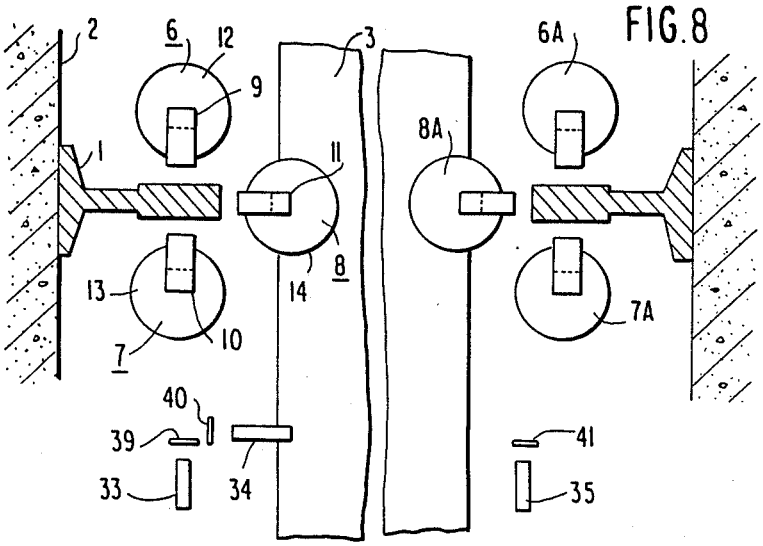
FIG. 8 is a partial, enlarged sectional view similar to FIG. 6 and illustrating an alternate embodiment.

An alternate embodiment is shown in FIG. 8, wherein the tracking standard cables 31, 32 are replaced by vertically tensioned steel straps 39, 40, 41 individually associated with the gap detectors 33, 34, 35.

What is claimed is:

1. A contactless guide system for an elevator installation including a pair of vertical guide rails (1) mounted to and extending inwardly from walls of a hoistway (2) on opposite sides of an elevator cage (3, 5) suspended in the hoistway for up and down travel, and a plurality of electromagnets (6, 7, 8) mounted on the cage and disposed confronting but spaced from surfaces of the guide rails, characterized by:

(a) continuous vertical tracking standard means (31, 32) mounted in the hoistway parallel to and spaced from the guide rails, (b) gap detector means (33, 34, 35) mounted on the cage and disposed proximate the tracking standard means for sensing air gaps between the tracking standard means and the detector means, and (c) control circuit means (18–22) for energizing the electromagnets in response to outputs from the gap detector means such that forces generated by the electromagnets act on the guide rails to maintain the sensed air gaps at predetermined values.

2. A guide system in accordance with claim 1, wherein:

(a) the tracking standard means comprises two vertically tensioned steel cables individually disposed on opposite sides of the cage, (b) there are three pairs of electromagnets, a first pair (6, 7) flanking a web of one of the guide rails, a second pair (6A, 7A) flanking a web of another one of the guide rails, and a third pair (8, 8A) disposed between innermost faces of the guide rails, and (c) the gap detector means comprising a first detector (33) disposed proximate a first one of the cables (31) and operatively associated with the first pair of electromagnets, a second detector (35) disposed proximate a second one of cables (32) and operatively associated with the second pair of electromagnets, and a third detector (34) disposed proximate said first one of the cables for sensing an air gap orthogonal to that sensed by the first detector and operatively associated with the third pair of electromagnets.

3. A guide system in accordance with claim 1, wherein:

(a) the tracking standard means comprises first and second vertically tensioned steel straps (39, 40) orthogonally disposed on one side of the cage, and a third vertically tensioned steel strap (41) disposed on another, opposite side of the cage, (b) there are three pairs of electromagnets, a first pair (6, 7) flanking a web of one of the guide rails, a second pair (6A, 7A) flanking a web of another one of the guide rails, and a third pair (8, 8A) disposed between innermost faces of the guide rails, and (c) the gap detector means comprises a first detector (33) disposed proximate the first strap and operatively associated with the first pair of electromagnets, a second detector (35) disposed proximate the third strap and operatively associated with the second pair of electromagnets, and a third detector (34) disposed proximate the second strap for sensing an air gap orthogonal to that sensed by the first detector and operatively associated with the third pair of electromagnets.

* * * * *